US010047620B2

(12) United States Patent
Giacché et al.

(10) Patent No.: US 10,047,620 B2
(45) Date of Patent: Aug. 14, 2018

(54) CIRCUMFERENTIALLY VARYING AXIAL COMPRESSOR ENDWALL TREATMENT FOR CONTROLLING LEAKAGE FLOW THEREIN

(71) Applicant: General Electric Company, Schenectady, NY (US)

(72) Inventors: Davide Giacché, Munich (DE); John David Stampfli, Greer, SC (US); Ramakrishna Venkata Mallina, Clifton Park, NY (US); Vittorio Michelassi, Munich (DE); Giridhar Jothiprasad, Clifton Park, NY (US); Ajay Keshava Rao, Bangalore (IN); Rudolf Konrad Selmeier, Fahrenzhausen (DE); Sungho Yoon, Munich (DE); Ivan Malcevic, Schenectady, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 671 days.

(21) Appl. No.: 14/572,119

(22) Filed: Dec. 16, 2014

(65) Prior Publication Data

US 2016/0169017 A1 Jun. 16, 2016

(51) Int. Cl.
*F01D 11/00* (2006.01)
*F04D 29/52* (2006.01)
(Continued)

(52) U.S. Cl.
CPC ..... *F01D 11/001* (2013.01); *F04D 29/526* (2013.01); *F04D 29/685* (2013.01);
(Continued)

(58) Field of Classification Search
CPC ..... F04D 29/685; F04D 29/526; F04D 29/68; F04D 29/681; F04D 27/02; F01D 11/001; F05D 2270/101; F05D 2270/17
See application file for complete search history.

(56) References Cited

U.S. PATENT DOCUMENTS 5,137,419 A 8/1992 Waterman
5,707,206 A 1/1998 Goto et al.
(Continued)

FOREIGN PATENT DOCUMENTS

WO 2016093811 A1 6/2016

OTHER PUBLICATIONS

Choi et al., "Design Optimization of Circumferential Casing Grooves for a Transonic Axial Compressor to Enhance Stall Margin", ASME Proceedings, Turbomachinery, pp. 687-695; 9 pages, 2010.

(Continued)

*Primary Examiner* — Justin Seabe
*Assistant Examiner* — Behnoush Haghighian
(74) *Attorney, Agent, or Firm* — GE Global Patent Operation; John Darling

(57) ABSTRACT

A compressor for a gas turbine engine including one or more endwall treatments for controlling leakage flow and circumferential flow non-uniformities in the compressor. The compressor includes a casing, a hub, a flow path formed between the casing and the hub, a plurality of blades positioned in the flow path, and one or more circumferentially varying endwall treatments formed in an interior surface of at least one of the casing or the hub. Each of the one or more circumferentially varying endwall treatments circumferentially varying based on their relative position to an immediately adjacent upstream bladerow. Each of the one or more endwall treatments is circumferentially varied in at least one (Continued)

of placement relative to the immediately adjacent upstream bladerow or in geometric parameters defining each of the plurality of circumferentially varying endwall treatments. Additionally disclosed is an engine including the compressor.

15 Claims, 10 Drawing Sheets

(51) Int. Cl.
*F04D 29/68* (2006.01)
*F04D 27/02* (2006.01)

(52) U.S. Cl.
CPC ..... *F04D 27/02* (2013.01); *F04D 29/68* (2013.01); *F04D 29/681* (2013.01)

(56) References Cited

U.S. PATENT DOCUMENTS 6,155,778 A * 12/2000 Lee ..... F01D 5/20 415/116
7,210,905 B2 5/2007 Lapworth
7,575,412 B2 8/2009 Seitz
8,251,648 B2 8/2012 Johann
8,419,355 B2 * 4/2013 Guemmer ..... F04D 29/685 415/170.1
8,550,768 B2 * 10/2013 Montgomery ..... F01D 5/143 415/1
8,573,946 B2 11/2013 Power et al.
8,777,558 B2 * 7/2014 Brunet ..... F04D 29/164 415/173.1
8,915,699 B2 * 12/2014 Brignole ..... F04D 29/526 415/58.5
2008/0044273 A1 2/2008 Khalid
2010/0329852 A1 12/2010 Brignole et al.
2016/0153360 A1 6/2016 Jothiprasad et al.
2016/0153465 A1 6/2016 Yoon et al.

OTHER PUBLICATIONS

Wu-Li et al., "Numerical and Experimental Investigations of the Flow in a Compressor with Circumferential Grooves", Journal of Aerospace Power, 2006.

* cited by examiner

CIRCUMFERENTIALLY VARYING AXIAL COMPRESSOR ENDWALL TREATMENT FOR CONTROLLING LEAKAGE FLOW THEREIN

BACKGROUND

The embodiments described herein relate generally to gas turbine engines and more particularly relate to an axial compressor endwall treatment for a gas turbine engine and a method for controlling leakage flow and circumferential flow non-uniformities therein.

As is known, an axial compressor for a gas turbine engine may include a number of stages arranged along an axis of the compressor. Each stage may include a rotor disk and a number of compressor blades, also referred to herein as rotor blades, arranged about a circumference of the rotor disk. In addition, each stage may further include a number of stator blades, disposed adjacent the rotor blades and arranged about a circumference of the compressor casing.

During operation of a gas turbine engine using a multi-stage axial compressor, a turbine rotor is turned at high speeds by a turbine so that air is continuously induced into the compressor. The air is accelerated by the rotating compressor blades and swept rearwards onto the adjacent rows of stator blades. Each rotor blade/stator blade stage increases the pressure of the air. In addition, during operation a portion of the compressed air may pass downstream about a tip of each of the compressor blades and/or stator blades as a leakage flow. Such stage-to-stage leakage of compressed air as leakage flow may affect the stall point of the compressor.

Compressor stalls may reduce the compressor pressure ratio and reduce the airflow delivered to a combustor, thereby adversely affecting the efficiency of the gas turbine. A rotating stall in an axial-type compressor typically occurs at a desired peak performance operating point of the compressor. Following rotating stall, the compressor may transition into a surge condition or a deep stall condition that may result in a loss of efficiency and, if allowed to be prolonged, may lead to failure of the gas turbine.

The operating range of an axial compressor is generally limited due to weak flow in rotor tips, where the specific rotor stall point is determined by the operating conditions, circumferential flow non-uniformities and compressor design. Prior attempts to increase the range of this operation and increase the stall margin have included flow control based techniques such as plasma actuation and suction/blowing near a blade tip. However, such attempts significantly increase compressor complexity and weight. Other attempts include end-wall treatments such as circumferential grooves, axial grooves, or the like. These end-wall treatments do not rotate with the rotor, and have a fixed relative position (both axially and circumferentially) to the upstream stationary blade-row. In addition, known end-wall treatments are predominantly oriented in the axial direction, and are all geometrically identical circumferentially about the entire annulus. It is known that the presence of upstream blades or struts introduce the circumferential flow non-uniformities. As such, these geometrically identical end-wall treatments are not designed to exploit/leverage the circumferentially non-uniform flows introduced by the upstream blade-row and are not an optimal arrangement to improve stall margins.

Thus, there is a desire for an improved axial compressor for a gas turbine engine and a method for controlling leakage flow about one or more blade tips in the presence of circumferential flow non-uniformities. Specifically, such a compressor may control leakage of compressed air through a carefully designed endwall treatment proximate the rotor and/or stator blades that provides desired recirculation of the leakage flow and addresses the circumferential flow non-uniformities. Control of such leakage and circumferential flow non-uniformities may increase operating range and stall margin of the compressor and the overall gas turbine engine while minimizing the detrimental impact on design point efficiency.

BRIEF DESCRIPTION OF THE DISCLOSURE

Aspects and advantages of the disclosure are set forth below in the following description, or may be obvious from the description, or may be learned through practice of the disclosure.

In one aspect, a compressor is provided. The compressor includes a casing; a hub; a cylindrical flow passage formed between the casing and the hub and defining a flow path; a plurality of blades positioned in the flow path; and one or more circumferentially varying end-wall treatments formed in an interior surface of at least one of the casing or the hub. The one or more endwall treatments are configured to return a flow adjacent one of a plurality of rotor blade tips or a plurality of stator blade tips to the cylindrical flow passage upstream of a point of removal of the flow. Each of the one or more endwall treatments is circumferentially varying based on their relative position to an immediately adjacent upstream bladerow.

In another aspect, a method is provided. The method including introducing a fluid flow along a cylindrical flow passage formed between a casing and a hub of a compressor, extracting a portion of the fluid flow into one or more circumferentially varied end-wall treatments formed in at least one of the casing and the hub, and flowing the portion of the fluid flow through the one or more circumferentially varied end-wall treatments to address circumferential flow non-uniformities introduced by an upstream blade-row. The cylindrical flow passage defining a flow path, wherein the compressor further comprises a plurality of blades positioned in the flow path. The one or more circumferentially varied end-wall treatments are formed in an interior surface of at least one of the casing or the hub. The one or more circumferentially varied endwall treatments are configured to return a flow adjacent one of the plurality of rotor blade tips or the plurality of stator blade tips to the cylindrical flow passage upstream of a point of removal of the flow, each of the one or more circumferentially varied endwall treatments is circumferentially varying based on their relative position to an immediately adjacent upstream bladero.

In yet another aspect, an engine is provided. The engine includes a compressor, a combustor and a turbine. The compressor, the combustor and the turbine are configured in a downstream axial flow relationship. The compressor further includes a casing; a hub; a flow path formed between the casing and the hub; a plurality of blades positioned in the flow path; and one or more circumferentially varying end-wall treatments formed in an interior surface of at least one of the casing or the hub. The one or more endwall treatments are configured to return a flow adjacent one of the plurality of rotor blade tips or the plurality of stator blade tips to the cylindrical flow passage upstream of a point of removal of the flow. Each of the one or more endwall treatments is circumferentially varying based on their relative position to an immediately adjacent upstream bladerow.

BRIEF DESCRIPTION OF THE DRAWINGS

A full and enabling disclosure of the present disclosure, including the best mode thereof to one skilled in the art, is set forth more particularly in the remainder of the specification, including reference to the accompanying figures, in which.

Corresponding reference characters indicate corresponding parts throughout the several views of the drawings.

DETAILED DESCRIPTION

The present disclosure will be described for the purposes of illustration only in connection with certain embodiments; however, it is to be understood that other objects and advantages of the present disclosure will be made apparent by the following description of the drawings according to the disclosure. While preferred embodiments are disclosed, they are not intended to be limiting. Rather, the general principles set forth herein are considered to be merely illustrative of the scope of the present disclosure and it is to be further understood that numerous changes may be made without straying from the scope of the present disclosure.

Preferred embodiments of the present disclosure are illustrated in the figures with like numerals being used to refer to like and corresponding parts of the various drawings. In addition, reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments. It is to be understood that the described inventive features may be combined in any suitable manner in the various embodiments. It is also understood that terms such as "top", "bottom", "outward", "inward", and the like are words of convenience and are not to be construed as limiting terms. It is to be noted that the terms "first," "second," and the like, as used herein do not denote any order, quantity, or importance, but rather are used to distinguish one element from another. The terms "a" and "an" do not denote a limitation of quantity, but rather denote the presence of at least one of the referenced item. The modifier "about" used in connection with a quantity is inclusive of the stated value and has the meaning dictated by the context (e.g., includes the degree of error associated with measurement of the particular quantity). In addition, the term "planform area" as used herein, is intended to encompass the shape of the intersection between the slot and the casing or hub endwall, e.g. the shape of the slot from a top view.

Embodiments disclosed herein relate to a compressor apparatus including one or more circumferentially varying endwall treatments to control leakage flow and circumferential flow non-uniformities there through the compressor. In contrast to known means of controlling flows through a compressor, the circumferentially varying endwall treatments as disclosed herein additionally address circumferential flow non-uniformities introduced by an upstream bladerow and provide for an increase in the limit of operability of the compressor, minimizing an efficiency penalty of the compressor and a resultant delay in rotor stall.

Figure 1:
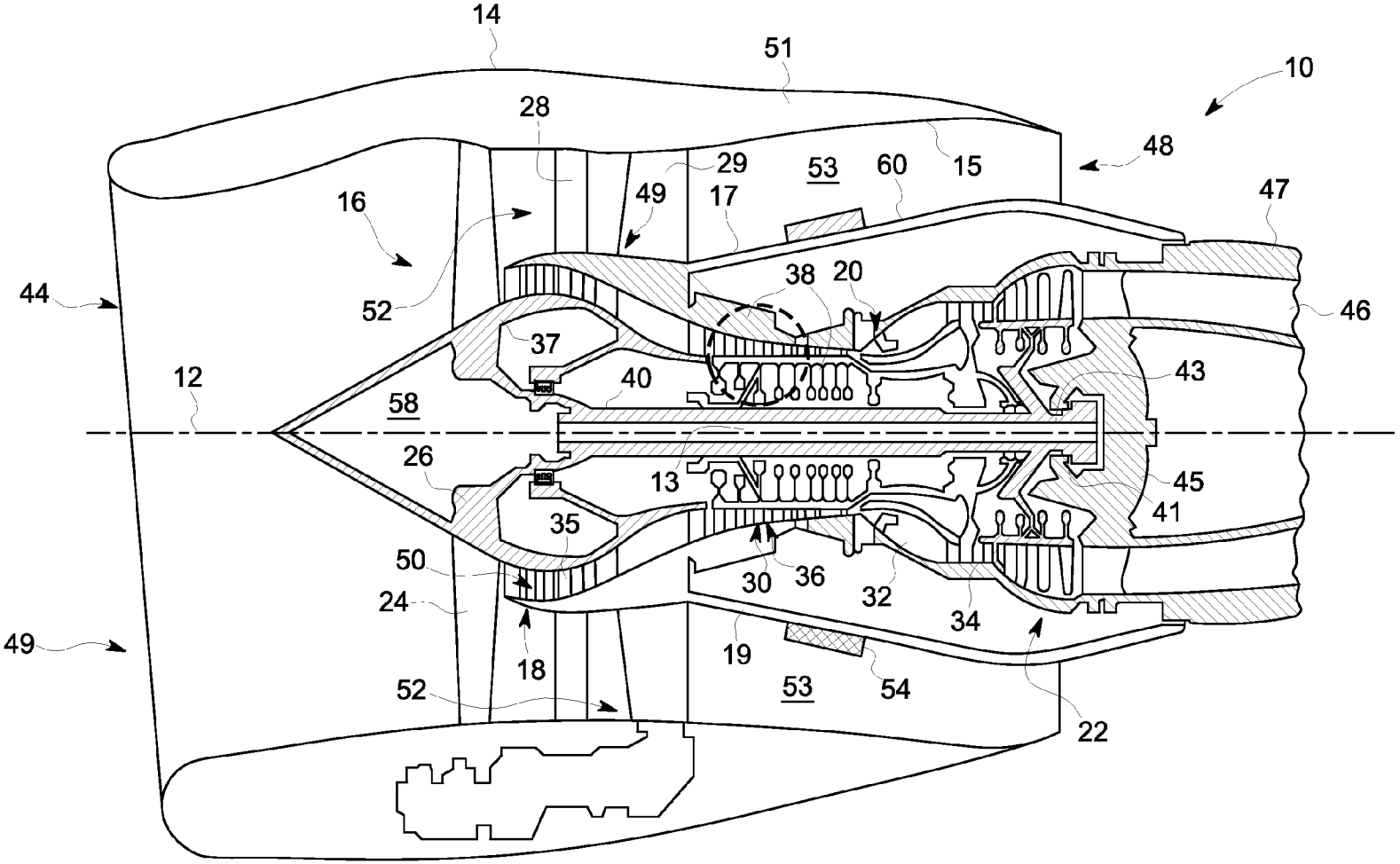
FIG. 1 is a schematic longitudinal cross-section of portion of an aircraft engine including a compressor having circumferentially varying endwall treatments, in accordance with one or more embodiments shown or described herein.
Figure 4:
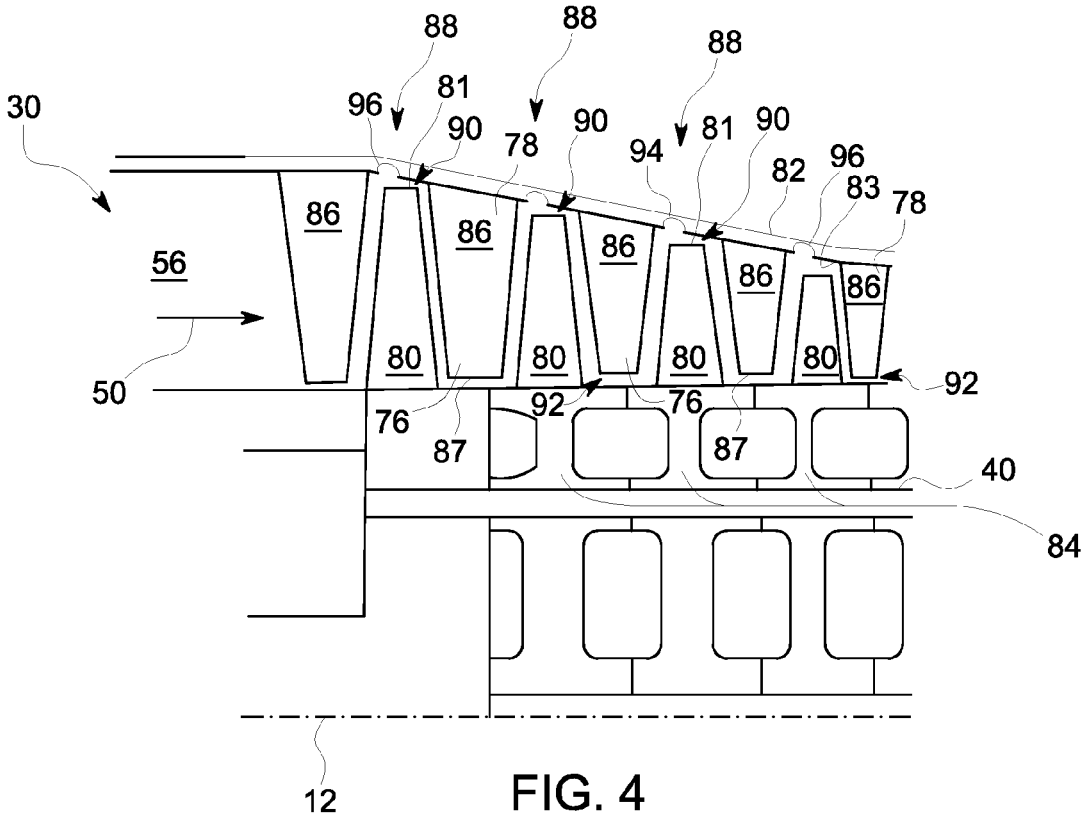
FIG. 4 is a schematic longitudinal cross-section of a portion of the compressor of the aircraft engine of FIG. 1, including a circumferentially varying endwall treatment, in accordance with one or more embodiments shown or described herein.

Referring to the drawings wherein identical reference numerals denote the same elements throughout the various views, FIG. 1 depicts a schematic illustration of an exemplary aircraft engine assembly 10, for purposes of example. The embodiments described herein are equally applicable to a stationary type of gas turbine such as a gas turbine used for industrial applications. It is noted that the portion of the engine assembly 10, illustrated in FIG. 4, is indicated by dotted line in FIG. 1. The engine assembly 10 has a longitudinal center line or longitudinal centerline axis 12 and an outer stationary annular fan casing 14 disposed concentrically about and coaxially along the longitudinal centerline axis 12. In the exemplary embodiment, the engine assembly 10 includes a fan assembly 16, a booster compressor 18, a core gas turbine engine 20, and a low-pressure turbine 22 that may be coupled to the fan assembly 16 and the booster compressor 18. The fan assembly 16 includes a plurality of rotor fan blades 24 that extend substantially radially outward from a fan rotor disk 26, as well as a plurality of structural strut members 28 and outlet guide blades ("OGVs") 29 that may be positioned downstream of the rotor fan blades 24. In this example, separate members are provided for the aerodynamic and structural functions. In other configurations, each of the OGVs 29 may be both an aerodynamic element and a structural support for an annular fan casing. The booster compressor includes a plurality of rotor blades 35 that extend substantially radially outward from a compressor rotor disk, or hub, 37 coupled to a first drive shaft 40.

The core gas turbine engine 20 includes a high-pressure compressor 30, a combustor 32, and a high-pressure turbine 34. The high-pressure compressor 30 includes a plurality of rotor blades 36 that extend substantially radially outward from a compressor hub 38. The high-pressure compressor 30 and the high-pressure turbine 34 are coupled together by a second drive shaft 41. The first and second drive shafts 40 and 41 are rotatably mounted in bearings 43 which are themselves mounted in a fan frame 45 and a turbine rear frame 47. The engine assembly 10 also includes an intake side 44, defining a fan intake 49, a core engine exhaust side 46, and a fan exhaust side 48.

During operation, the fan assembly 16 compresses air entering the engine assembly 10 through the intake side 44. The airflow exiting the fan assembly 16 is split such that a portion 50 of the airflow is channeled into the booster compressor 18, as compressed airflow, and a remaining portion 52 of the airflow bypasses the booster compressor 18 and the core gas turbine engine 20 and exits the engine assembly 10 via a bypass duct 53, through the fan exhaust side 48 as bypass air. More specifically, the bypass duct 53 extends between an interior wall 15 of the fan casing 14 and an outer wall 17 of a booster casing 19. This portion 52 of the airflow, also referred to herein as bypass air flow 52, flows past and interacts with the structural strut members 28, the outlet guide blades 29 and a heat exchanger apparatus 54. The plurality of rotor fan blades 24 compress and deliver the compressed airflow 50 towards the core gas turbine engine 20. Furthermore, the airflow 50 is further compressed by the high-pressure compressor 30 and is delivered to the combustor 32. Moreover, the compressed airflow 50 from the combustor 32 drives the rotating high-pressure turbine 34 and the low-pressure turbine 22 and exits the engine assembly 10 through the core engine exhaust side 46.

Figure 2:
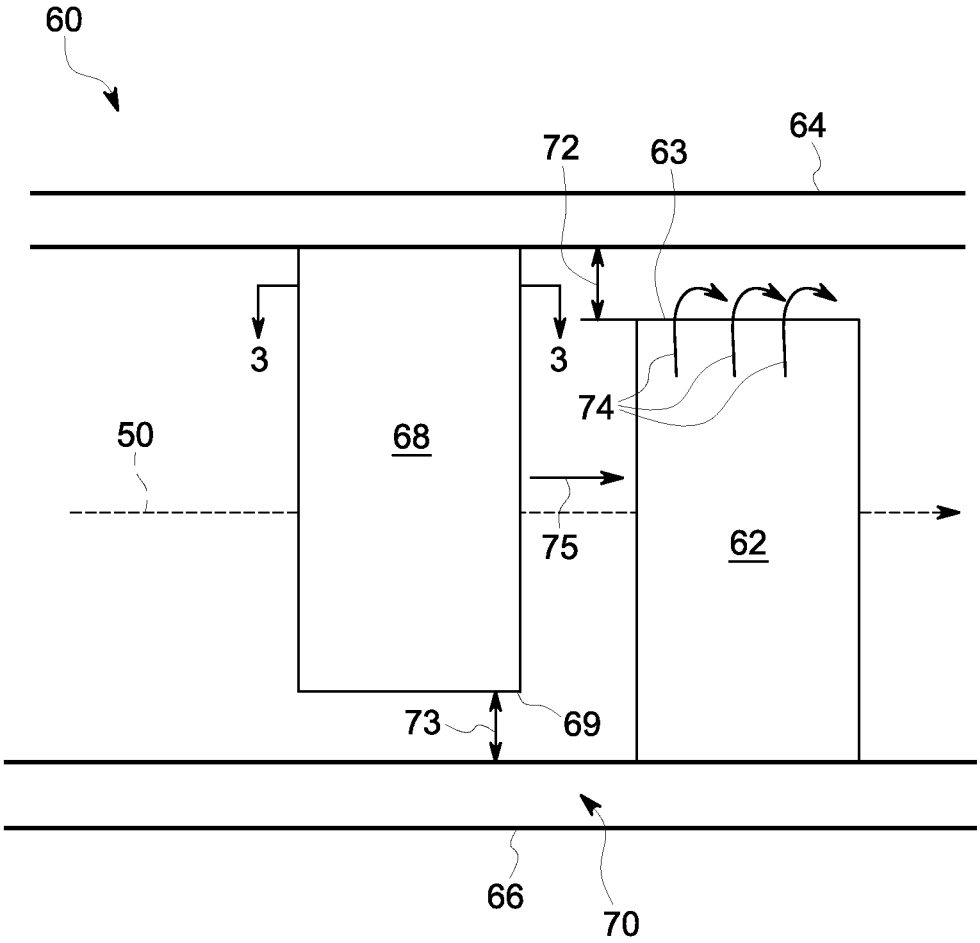
FIG. 2 (PRIOR ART)
FIG. 2 is a schematic longitudinal cross-section of a portion of a compressor as known in the art.
Figure 3:
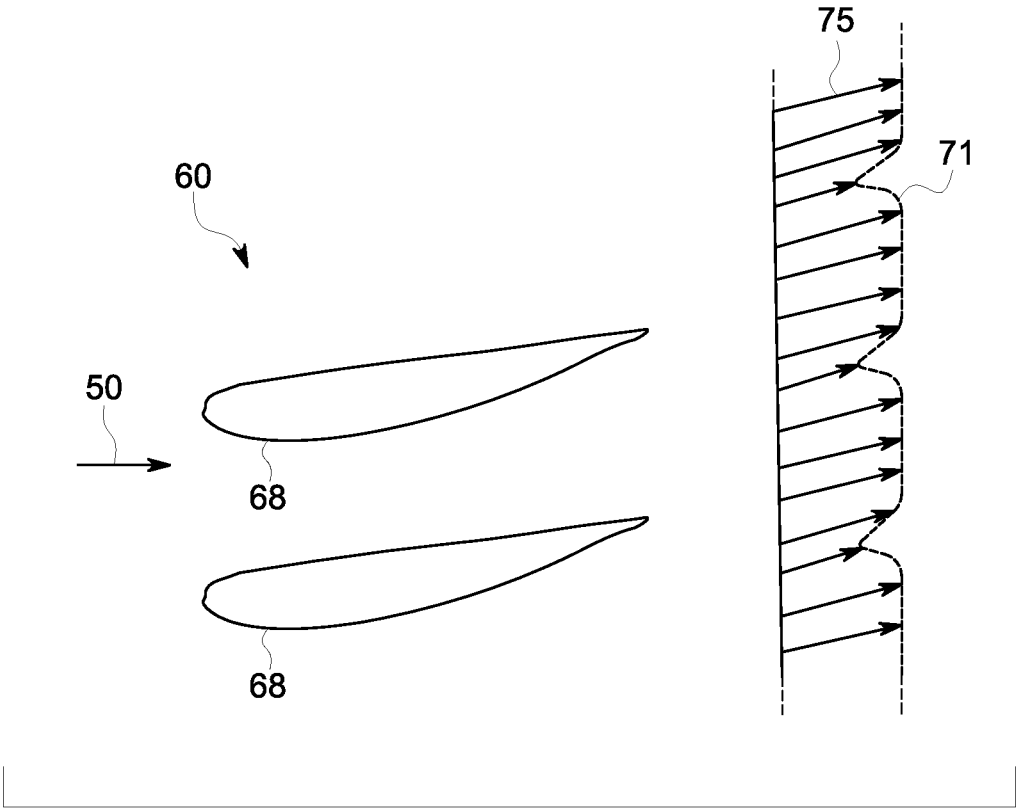
FIG. 3 (PRIOR ART)
FIG. 3 is a schematic plan view of a portion of the compressor of FIG. 2 as known in the art.

Referring now to FIGS. 2-3, illustrated schematically is a portion of a compressor 60, as generally known in the art and labeled as Prior Art. As indicated, FIG. 3 is taken along line 3-3 of FIG. 2. The compressor 60 includes a plurality of sets of circumferentially spaced rotor blades 62 that extend radially outward towards a compressor casing 64 from a compressor hub 66. A plurality of sets of circumferentially-spaced stator blades 68 (of which only a single stator blade is shown in FIG. 2) are positioned adjacent to each set of rotor blades 62, and in combination form one of a plurality of stages 70 (of which only a single stage is shown in FIG. 2). Each of the stator blades 68 is securely coupled to the compressor casing 64 and extends radially inward to interface with the compressor hub 66. Each of the rotor blades 62 is circumscribed by the compressor casing 64, such that an annular gap 72 is defined between the compressor casing 64 and a rotor blade tip 63 of each blade in the set of rotor blades 62. Likewise, the stator blades 68 are disposed relative to the compressor hub 66, such that an annular gap 73 is defined between the compressor hub 66 and a stator blade tip 69 of each of the stator blades 68.

During operation, an operating range of the compressor 60 is generally limited due to leakage flow, as indicated by directional arrows 74, proximate the rotor blade tips 63. In an embodiment, leakage flow (not shown) may also be present proximate the stator blade tips 69. In addition to leakage flow 74, the upstream stator blades 68 or struts typically introduce circumferential flow non-uniformities 75. As best illustrated in FIG. 3, the circumferential flow-non-uniformities 75 are present in the form of a plurality of wakes 71 introduced by the presence of the upstream blade row, and in the illustration, the plurality of stator blades 68.

A specific rotor stall point is determined by the operating conditions and the compressor design. To increase the range of this operation, previous compressors have included end-wall treatments (not shown), such as circumferential grooves, in an attempt to provide an increase in the operating range by redirecting and/or minimizing leakage flow 74. Due to these endwall treatments being formed geometrically identical circumferentially about the entire annulus, previous known endwall treatments have failed to additionally address the circumferential flow non-uniformities 75 introduced by upstream blade-rows. Disclosed herein are novel end-wall treatments that address both the leakage flow about the blade tips and exploit/leverage the circumferential flow non-uniformities introduced by the upstream blade-row to improve stall margins.

Referring more specifically to FIG. 4, illustrated is a portion of the novel compressor 30, as presented in FIG. 1. As illustrated, in the exemplary embodiment, the compressor 30 includes at least one set of rotor blades 76, also referred to herein as a rotor blade row, each set comprising a plurality of rotor blades 80 that are circumferentially spaced and that extend radially outward towards a compressor casing 82 from a compressor hub, or rotor disk, 84 coupled to the first drive shaft 40. At least one set of stator blades 78, also referred to herein as a stator blade row, each set comprising a plurality of circumferentially-spaced stator blades 86, are positioned adjacent to each set of rotor blades 76, and in combination form one of a plurality of stages 88. The stator blades 86 are securely coupled to the compressor casing 82 and extend radially inward to interface with the compressor hub 84. Each of the plurality of stages 88 directs a flow of compressed air through the compressor 30. The rotor blades 80 are circumscribed by the compressor casing 82, such that an annular gap 90 is defined between the compressor casing 82 and a rotor blade tip 81 of each of the rotor blades 80. Likewise, the stator blades 86 are disposed relative to the compressor hub 84, such that an annular gap 92 is defined between the compressor hub 84 and a stator blade tip 87 of each of the stator blades 86.

As is typical in the art, each gap 90 and 92 is sized to facilitate minimizing a quantity of compressed air 50 that bypasses the rotor blades 80 and stator blade 86, respectively, defining a leakage flow, such as leakage flow 74 (FIG. 2). It has been found that in addition to addressing the leakage flow, upstream bladerows or struts introduce circumferential flow non-uniformities that when addressed provide an increase in stall margin and an opportunity to reduce efficiency penalty at design.

To provide for recirculation of that portion of compressed air 50 that presents as leakage flow proximate the rotor blade tips 81 and/or stator blade tips 87 and that portion of the compressed air 50 that presents as circumferential flow non-uniformities, the novel compressor 30 disclosed herein includes one or more circumferentially varying endwall treatments 94. As used herein, the term "endwall" is intended to encompass the compressor casing 82 and/or the compressor hub 84 and provide for a generally cylindrical flow passage 56 defining a flow path 57 between the compressor casing 82 and the compressor hub 84.

Figure 5:
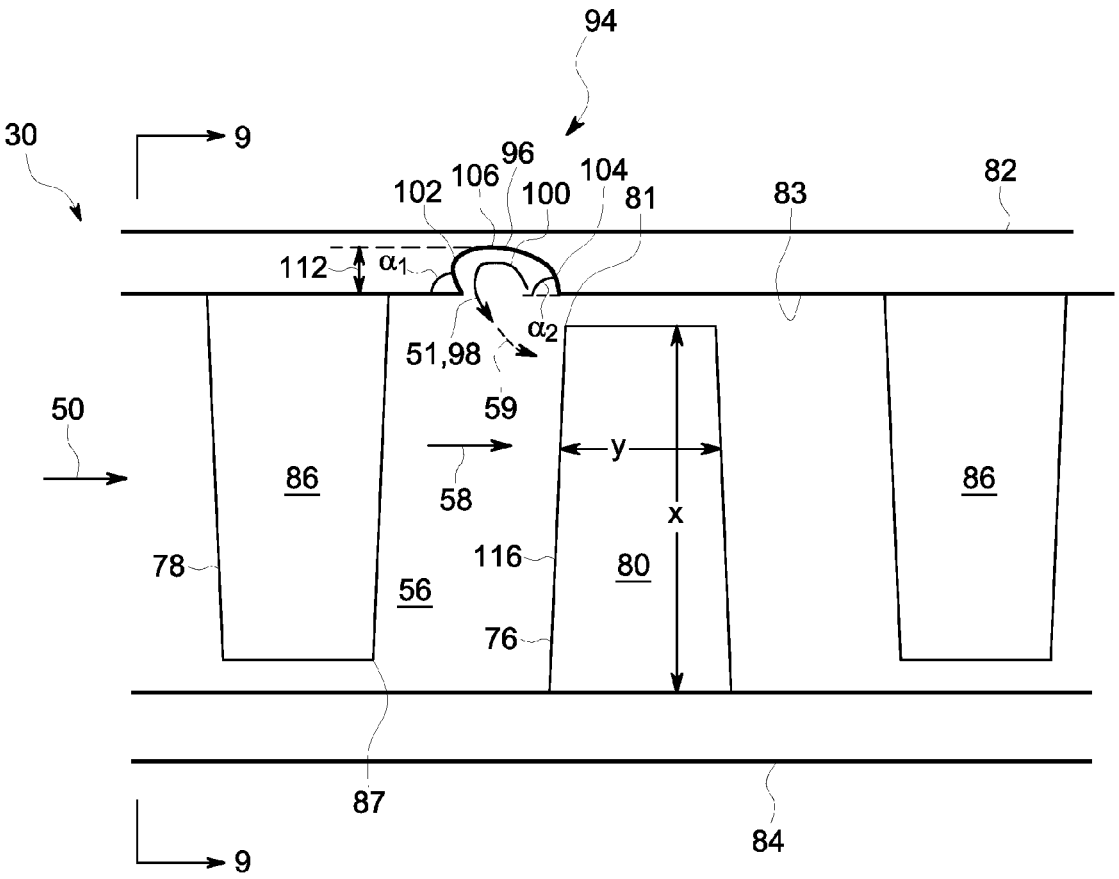
FIG. 5 is a schematic longitudinal cross-section of a portion of the compressor of FIG. 4, including a circumferentially varying endwall treatment, in accordance with one or more embodiments shown or described herein.

Referring now to FIG. 5, illustrated schematically is a longitudinal cross-section of a portion of the compressor 30 including the one or more circumferentially varying endwall treatments 94 (of which only one is shown). As illustrated, in this particular embodiment, the one or more circumferentially varying endwall treatments 94 are configured as a plurality of discrete circumferentially varying slots 96 formed into an interior surface 83 of the compressor casing 82 and disposed circumferentially thereabout proximate the rotor blade tips 81 and positioned relative to an upstream blade row, such as the bladerow 78 of the plurality of stator blades 86. Each of the plurality of circumferentially varying slots 96, in general is aligned substantially along the principal axis, and more particularly, the longitudinal centerline axis 12 (FIG. 1) so that a flow recirculation 98 in these slots is generally along this principal direction. As indicated by the flow recirculation directional arrow 98, the one or more endwall treatments 94 are configured to recirculate 98, and more particularly, return the flow 50 adjacent the plurality of rotor blade tips 81 to the cylindrical flow passage 56 upstream of a point of removal of the flow 50. Each slot 96 has a cross-section in the plane of this principal direction that facilitates flow recirculation 98 over the rotor blade tip 81. It should be understood that the cross-sections between the slots 96 are designed to vary circumferentially about the compressor casing 82 in an attempt to address circumferential flow non-uniformities off of the upstream stator blade 86 or stationary components. The position of each of the slots 96, orientation, cross-section definition and additional geometrical parameters may be optimized to provide specific solution for any application that desires an increase in stable operating range. In addition it should be understood that the disclosed orientation, cross-section definition and additional geometrical parameters may vary from one slot to the next circumferentially about the annulus of the compressor.

Specifically, in the exemplary illustrated embodiment of FIG. 5, the one or more circumferentially varying endwall treatments 94, and more particularly, the plurality of discrete circumferentially varying slots 96 facilitate reducing the detrimental effect of leakage flows of compressed air between the compressor casing 82 and the rotor blade tip 81 while addressing the circumferential flow non-uniformities present as a result of an upstream stationary blades/struts. More specifically, the plurality of discrete circumferentially varying slots 96 facilitate the conversion of the uselessness of leakage flows and flow non-uniformities into useful flows to increase the stall margin. During operation, the portion of air flow 50 flows into the aircraft engine assembly 10 through the fan intake 49 (FIG. 1) and towards the compressor 30. The stator blades 86 direct the compressed air towards the rotor blades 80. The compressed air extracts extra work input from the rotor blades 80 which rotate about the longitudinal centerline axis 12 of the compressor 30 while the stator blades 86 remain stationary and compressing the air flowing through each of the plurality of stages 88. In this manner, the rotor blades 80 cooperate with the adjacent stator blades 86 to impart kinetic energy to and compress the incoming flow of air 50, which is then delivered to the combustor 32. Other types of compressor configurations may be used.

The one or more endwall treatments 94, and more particularly the plurality of circumferentially varying discrete slots 96, assist in delaying rotor stall by extracting weak tip flow through an aft segment 100 of a leakage flow 51, that is exposed to the rotor blade tip 81 and by exploiting/leveraging a circumferentially non-uniform flow(s) 58 introduced by the upstream blade-row, which in this particular embodiment is an upstream stator bladerow 78. The flows 51 and 58 are then recirculated and strengthened within each of the circumferentially varying slots 96, and injected back into the main flow 50 ahead of the rotor blade 80 through the forward segment as a reinjected flow 59. It should be understood that the position of the plurality of circumferentially varying slots 96 relative to the rotor blade tips 81 and/or upstream stationary bladerow, such as stator blades 86, circumferential distribution about the casing 82, clocking of the plurality of circumferentially varying slots 96 relative to the upstream stationary bladerow, such as stator blade row 86, geometrical shape of each of the plurality of circumferentially varying slots 96 and repetition pattern, if any, of the plurality of circumferentially varying slots 96 is shown for illustration purposes only, and described more in depth below. In practice, the specific configuration of the one or more circumferentially varying endwall treatments 94 is optimized to address the leakage flow 51 and the circumferentially non-uniform flow(s) 58 present in the particular application on which they are deployed.

Referring again to FIG. 5, in the illustrated embodiment, the plurality of circumferentially varying slots 96 are configured relative to the plurality of rotor blades 80, and more particularly the rotor blade tips 81, and the upstream stationary blade row, such as the plurality of circumferentially-spaced stator blades 86. As illustrated, each of the plurality of circumferentially varying slots 96 is defined by a front wall 102, a rear wall 104, and an outer wall 106, between the front wall 102 and the rear wall 104. Each of the plurality circumferentially varying slots 96 is further defined by a radial height 112, a first axial lean angle $\alpha_1$ relative to the longitudinal centerline axis 12 (FIG. 1), a second axial lean angle $\alpha_2$ relative to the longitudinal centerline axis 12 (FIG. 1), a first tangential lean angle and a second tangential lean angle, (described presently). In an embodiment, the radial height 112 is defined as a radially outer-most point belonging to a casing treatment slot 96. In an embodiment, first axial lean angle $\alpha_1$ and the second axial lean angle $\alpha_2$ may be equal. In an embodiment, the first axial lean angle $\alpha_1$ and the second axial lean angle $\alpha_2$ may not be equal. In an embodiment, the radial height 112 of each of the plurality of slots 96 is approximately 5-50% of the span "x" of the rotor blades 80 and may vary one from another. In an embodiment, each of the plurality of circumferentially varying slots 96 may further include slot width variations along an axis of the slot and/or in a radial direction (described presently). In an embodiment, each of the plurality of circumferentially varying slots 96 may further include an axial overhang, an axial overlap and/or a bend angle. The axial overhang is a portion of the circumferentially varying slot 96 that extends upstream of the rotor blades 80 from the forward blade edge tip 81 of the rotor blades 80 to the front wall 102. The axial overlap is a portion of the circumferentially varying slot 96 that extends from forward blade edge tip 81 of the rotor blades 80 in a downstream direction, thereby essentially overlapping a portion of the rotor blades 80. Additional information regarding the inclusion of axial overlaps, axial overhangs, axial lean angles and tangential lean angles are disclosed in copending patent application bearing U.S. Ser. No. 14/556,452, entitled, "Axial Compressor Endwall Treatment for Controlling Leakage Flow Therein", filed on Dec. 1, 2014, and assigned to the same assignee as here, which application is incorporated herein by reference in its entirety. Additional information regarding the inclusion of bend angles are disclosed in copending patent application bearing International Application Number PCT/US14/69433, entitled, "Compressor End-Wall Treatment Having a Bent Profile", filed on Dec. 10, 2014, and assigned to the same assignee as here, which application is incorporated herein by reference in its entirety.

Figure 6:
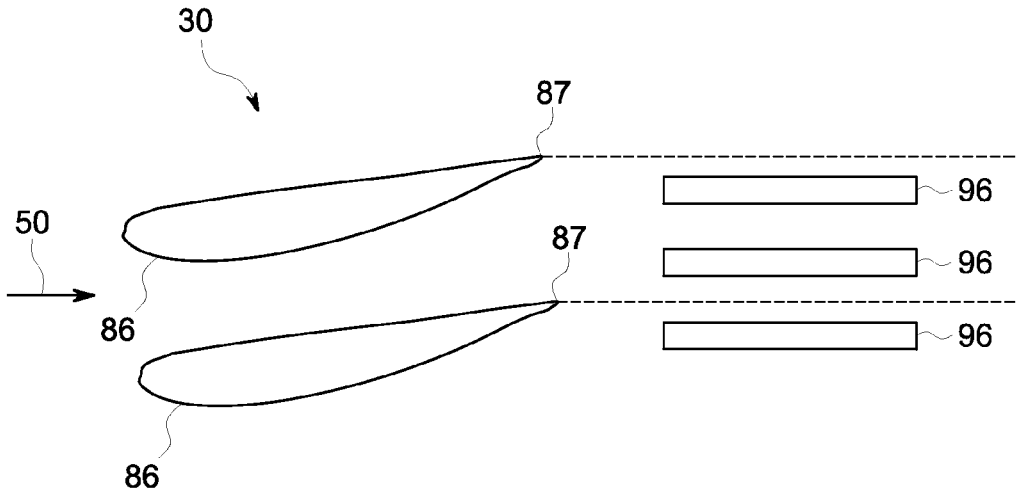
FIG. 6 is a schematic plan view of a portion of the compressor of FIG. 5, including a circumferentially varying endwall treatment, in accordance with one or more embodiments shown or described herein.
Figure 7:
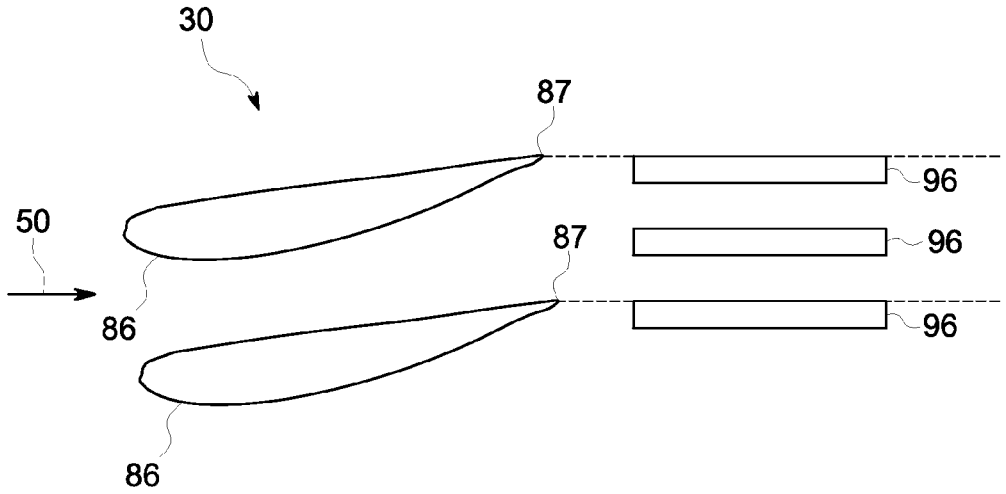
FIG. 7 is a schematic plan view of a portion of the compressor of FIG. 5, including an alternate clocking configuration for the circumferentially varying endwall treatment, in accordance with one or more embodiments shown or described herein.

Referring now to FIGS. 6 and 7, illustrated schematically is a portion of a compressor, and more particularly an upstream bladerow, such as a bladerow including the plurality of stator blades 86 and a plurality of circumferentially varying slots 96, configured relative to the upstream stator blades 86. In this particular embodiment, the circumferentially varying slots 96 are each configured geometrically identical, and only the relative position of the circumferentially varying slots 96 relative to the upstream stator blades 86 was varied circumferentially (referred to herein as "clocking"). As best illustrated in FIG. 6, each of the circumferentially varying slots 96 is disposed within the casing 82 (FIG. 4) and downstream from bladerow of stator blades 86. In this particular embodiment, the plurality of circumferentially varying slots 96 are positioned offset from the blade tip 87 of each of the plurality of stator blades 86, as indicated by the dashed line, and equally spaced circumferentially about the casing 82 (FIG. 4). In the embodiment of FIG. 7, the plurality of circumferentially varying slots 96 are positioned inline with the blade tip 87 of each of the plurality of stator blades 86, as indicated by the dashed line, and equally spaced circumferentially about the casing 82 (FIG. 4). By varying the clocking position of the plurality of circumferentially varying slots 96 an increase in stall margin and an opportunity to reduce efficiency penalty at the design point is achieved. In studies conducted it has been shown that a 0.5-1.0% stall margin improvement could be achieved. In alternate embodiments, the circumferential spacing between adjacent circumferentially varying slots 96 and/or the geometric shape, and more particularly one or more geometric parameters (described presently) of the one or more of the circumferentially varying slots 96 may be varied in addition to the clocking of the circumferentially varying slots 96 relative to the upstream stationary bladerow.

Figure 8:
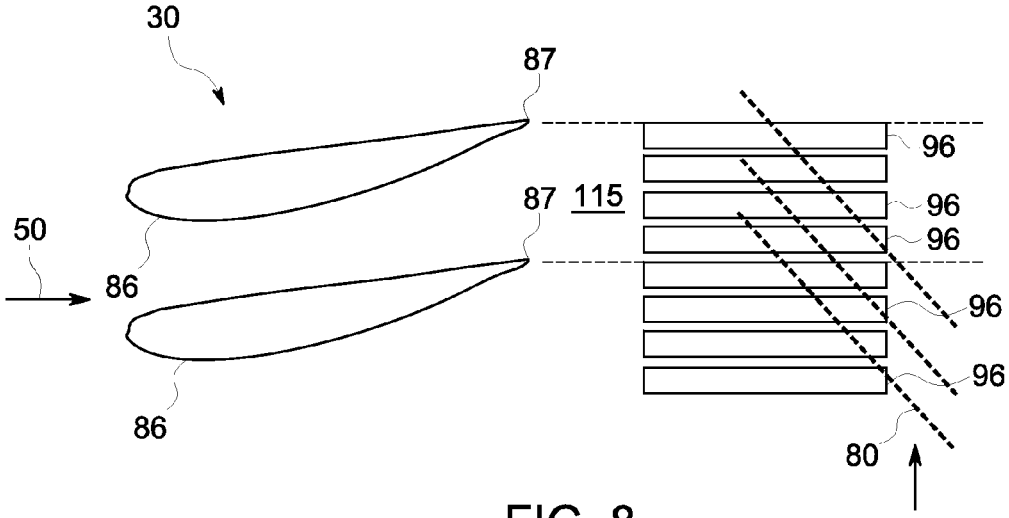
FIG. 8 is a schematic plan view of a portion of the compressor of FIG. 5, including an alternate circumferentially varying endwall treatment configured for greater mass flow, in accordance with one or more embodiments shown or described herein.

Referring now to FIG. 8, illustrated schematically is another embodiment of a portion of a compressor, and more particularly an upstream bladerow, such as a bladerow including the plurality of stator blades 86, a downstream rotating bladerow, such as a bladerow including the plurality of rotors 80 and a plurality of circumferentially varying slots 96, configured relative to the upstream stator blades 86. In this particular embodiment, the circumferentially varying slots 96 are again each configured geometrically identical, and only the relative position and number of circumferentially varying slots 96 disposed within a blade passage 115 and relative to the upstream stator blades 86 is varied circumferentially. It is anticipated that the number of circumferentially varying slots 96 disposed within a blade passage 115 does not need to be an integer number, and in an embodiment, may include a non-integer number of slots 96 disposed within the blade passage 115. As best illustrated in FIG. 8, each of the circumferentially varying slots 96 is disposed within the casing 82 (FIG. 4) and downstream from bladerow of stator blades 86. In this particular embodiment, the plurality of circumferentially varying slots 96 are positioned inline with the blade tip 87 of each of the plurality of stator blades 86, as indicated by the dashed line, and equally spaced circumferentially about the casing 82 (FIG. 4). It has been shown that the mass flow recirculating through each slot 96 depends on its relative position to the upstream blade-row 86. The effectiveness of the circumferentially varying endwall treatment 94 (both in terms of stall margin improvement and efficiency penalty at the design point) depends on the mass flow recirculating through the plurality of circumferentially varying slots 96 and the direction at which said mass is reintroduced and mixes with the main flow 50. In an embodiment, the mass flow recirculation and the direction at which the mass flow is reintroduced is determined by the number of slots 96 circumferentially spaced about the casing 82. In an embodiment, each of the plurality of circumferentially varying slots 96 recirculates a different mass flow. Therefore, the geometry of each of the plurality of circumferentially varying slots 96 can be further tuned to achieve the maximum stall margin improvement and the least efficiency penalty.

Figure 9:
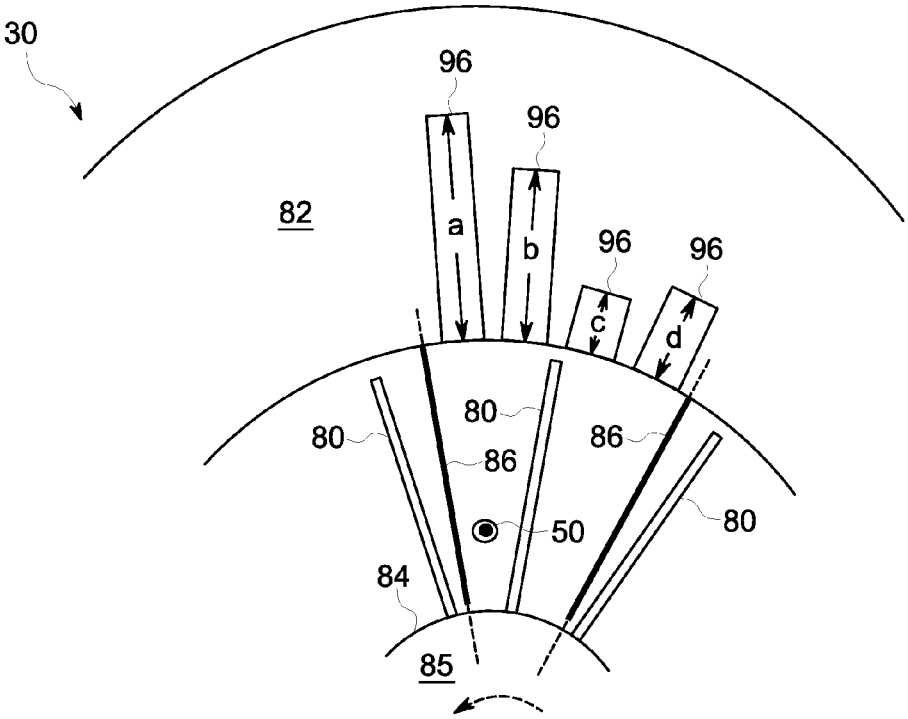
FIG. 9 is a schematic axial cross-section of an alternate embodiment of a compressor, including a circumferentially varying endwall treatment, in accordance with one or more embodiments shown or described herein.

As previously alluded to, varying geometric parameters of each of the plurality of circumferentially varying slots 96 results in higher stall margin improvement and lower efficiency penalty at design point to be achieved over that of conventional end-wall treatment designs. Referring more specifically to FIG. 9, illustrated is a schematic cross-sectional view taken along line 9-9 of FIG. 5. As illustrated, the flow 50 is into the page. As previously indicated, like elements have like numbers throughout the disclosed embodiments. Similar to the previously disclosed embodiment, the compressor 30 includes a plurality of rotor blades 80 that are circumferentially spaced and that extend radially outward towards a compressor casing 82 from a compressor hub 84. A plurality of circumferentially-spaced stator blades 86 are positioned upstream and adjacent to each set of rotor blades 80, and in combination form one of a plurality of stages 88 (FIG. 4). The stator blades 86 are securely coupled to the compressor casing 82 and extend radially inward from toward the compressor hub 84 from the compressor casing 82 to a stator blade tip 87. Each of the plurality of stages 88 directs a flow of compressed air through the compressor 120

In this particular embodiment, a plurality of circumferentially varying slots 96 are configured relative to the upstream stator blades 86 and including one or more varying geometric parameters, and more specifically, including varying radial heights 112 (FIG. 5), designated "a", "b", "c" and "d". As best illustrated in FIG. 9, each of the circumferentially varying slots 96 is disposed within the casing 82 and downstream from bladerow of stator blades 86. In this particular embodiment, the plurality of circumferentially varying slots 96 are positioned offset from the blade tip 87 of each of the plurality of stator blades 86, as indicated by the dashed line and as previously described with regard to FIG. 7, and equally spaced circumferentially about the casing 82 (FIG. 4). By varying the radial height of the plurality of circumferentially varying slots 96, the casing design can be optimized to address the leakage flow 51 (FIG. 5) and the circumferentially non-uniform flow(s) 59 (FIG. 5) present in the particular application on which they are deployed. By varying the geometrical parameters, such as radial height, of the plurality of circumferentially varying slots 96 provide an increase in stall margin and an opportunity to reduce efficiency penalty at the design point is achieved.

Figure 10:
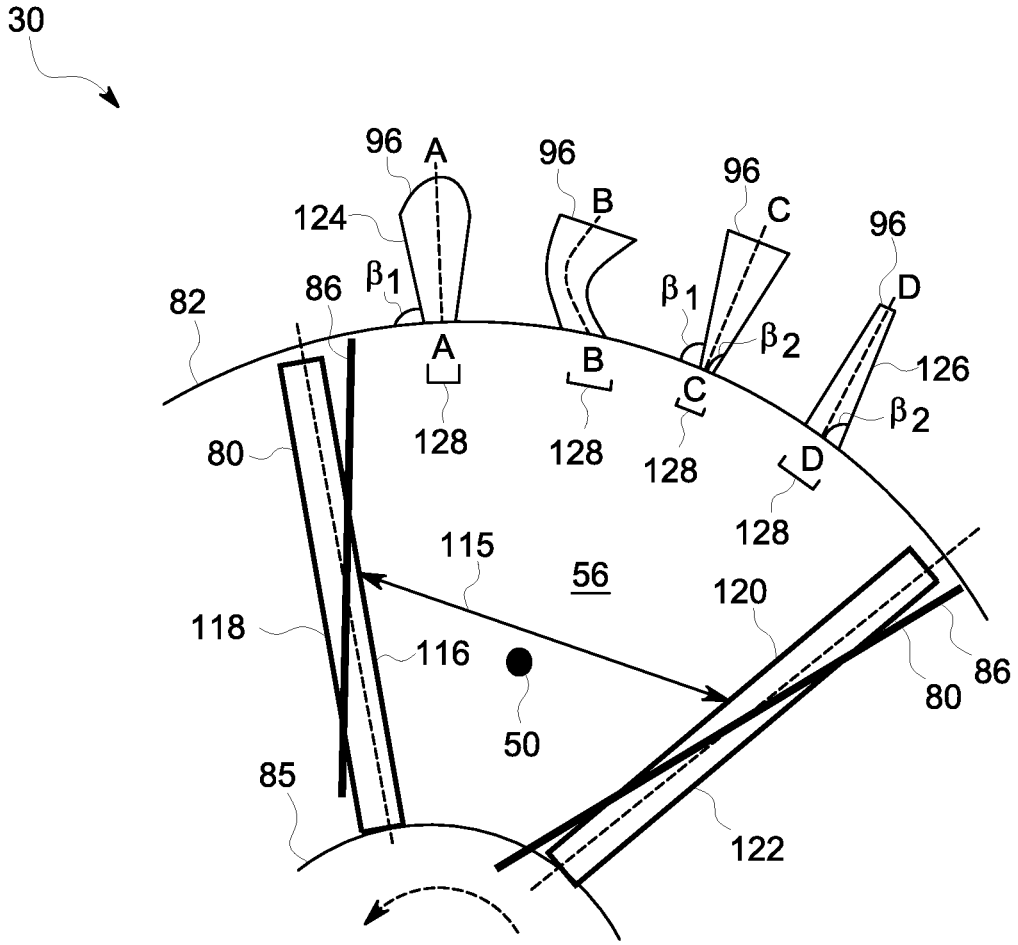
FIG. 10 is a schematic axial cross-section of an alternate embodiment of a portion of a compressor, including a circumferentially varying endwall treatment, in accordance with one or more embodiments shown or described herein.
Figure 11:
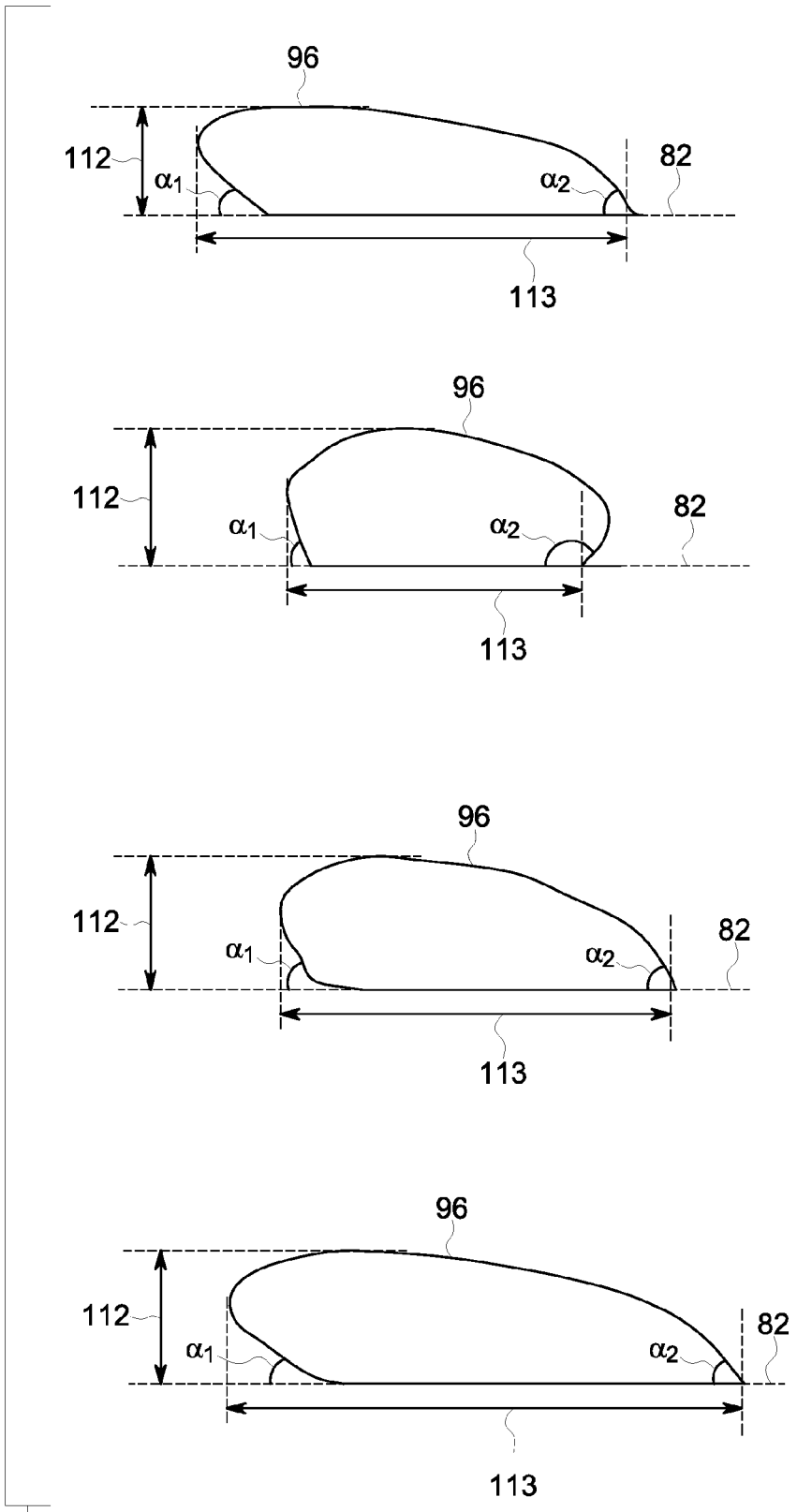
FIG. 11 are schematic axial cross-sections of the individual circumferential discrete slots that comprise the circumferential endwall treatment of FIG. 10, in accordance with one or more embodiments shown or described herein.
Figure 12:
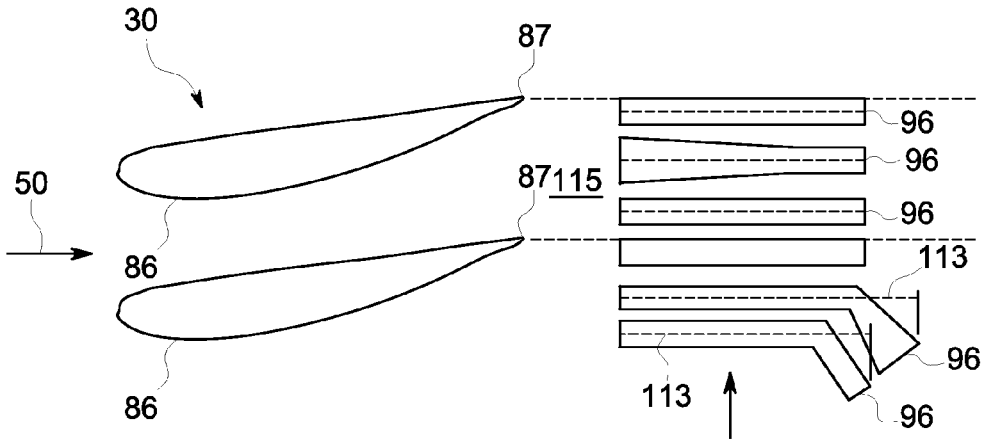
FIG. 12 is a schematic plan view of a portion of the compressor of FIG. 5, including an alternate circumferentially varying endwall treatment, in accordance with one or more embodiments shown or described herein.

As described herein, each of the circumferentially varying slots 96 may include unique geometrical parameters including, but not limited to, axial and tangential lean angles, radial height, axial length, axial widths, radial widths, bend angles, planform area, or the like. Referring now to FIGS. 10-12, illustrated are additional exemplary geometrical varying configurations of the plurality of circumferentially varying slots 96. FIG. 10 is a schematic radial cross-section illustrating four (4) circumferentially varying slots 96. FIG. 11 is an axial cross-section of each slot 96, taken along lines A-A, B-B, C-C and D-D of FIG. 10. FIG. 12, illustrates in plan view, another embodiment illustrating six (6) circumferentially varying slots 96 including varying geometric parameters. In the illustrated embodiments of the circumferentially varying slots 96, each slot includes geometrical parameters that may be varied one from another of the plurality of circumferentially varying slots 96. As best illustrated in FIGS. 10 and 11, each slot of the plurality of circumferentially varying slots 96, includes a radial height 112, axial lean angles $\alpha_1$ and $\alpha_2$, tangential lean angles $\beta_1$ and $\beta_2$, that may vary along a axial length of a slot 96 resulting in varying radially widths within each slot 96 (as best illustrated in FIG. 12), an axial length 113 and a planform area, all of which may vary one slot 96 from another slot 96 for purposes of tuning the plurality of circumferentially varying slots 96 to address leakage flow and circumferential flow non-uniformities. As best illustrated in FIG. 12, each slot of the plurality of circumferentially varying slots 96, may further include varying slot widths and bend angles along the longitudinal axis 12 (FIG. 1), as illustrated, all of which may vary one slot 96 from another slot 96 for purposes of tuning the plurality of circumferentially varying slots 96 to address leakage flow and circumferential flow non-uniformities.

Referring again to FIG. 11, each of the one or more endwall treatments 94, in the form of the plurality of circumferentially varying axial slots 96 includes a geometric shape having an overall curvature from the front wall 102 to the rear wall 104 (FIG. 5). Appropriate choice of curvature can minimize aerodynamic loss within slots. Each of the axial slots 96 may be optimized to provide specific solution for any application that desires an increase in stable operating range. Some of the aspects that may be optimized, include, but are not limited to: (i) the axial lean angle $\alpha_1$ of the front wall 102 and axial lean angle $\alpha_2$ of the aft wall 104 of each of the circumferentially varying axial slots 96; (ii) the tangential lean angles of each of the circumferentially varying axial slots 96; (iii) the radial height 112 of each of the circumferentially varying slots 96; (iv) a length of the axial overhang and the length of the axial overlap; (v) a tangential spacing between adjacent circumferentially varying slots 96 and within each slot 96 (described presently), (vi) a number of circumferentially varying slots 96 spaced circumferentially about the endwall (described presently); (viii) an overall geometric cross-section of each circumferentially varying slot 96 when viewed in a radial-axial plane; and (viii) any variation of the above parameters in the radial, axial and tangential direction.

In the embodiments of FIGS. 4-12, to provide for recirculation of that portion 51 of compressed air 50 proximate the rotor blade tips 81 and exhibited as circumferential non-uniform flow(s), the novel compressor 30 includes the one or more circumferentially varying endwall treatments 94, configured as the plurality of circumferentially varying slots 96 extending circumferentially about the casing 82. In the illustrated embodiments, the plurality of circumferentially varying slots 96 are shown as embedded in the casing hardware. It should be understood, that anticipated is an embodiment including a plurality of circumferentially varying slots embedded in the hub hardware only, and more particularly into an interior surface 85 of the compressor hub 84, disposed circumferentially thereabout and positioned relative to an upstream blade row or a plurality of circumferentially varying slots embedded in both the hub 84 and casing 82 hardware.

Referring again to FIG. 10, illustrated in radial cross-sectional views is the blade passage 115 (of which only one is illustrated) defined between adjacent stator blades 80, and more particularly between a suction side 116 of a first blade 118 and pressure side 120 of an adjacently positioned second blade 122. In an embodiment, the spacing of the plurality of circumferentially varying slots 96 circumferentially about the casing 82 is approximately 0-10 slots per blade passage 134, as best illustrated in FIG. 10, but can vary for each blade passage 115 and may include any integer or non-integer number of blades. It should be also noted that in alternate embodiments, some blade passages may not include slots, whereas other blade passages include slots.

As illustrated in FIG. 10, each of the plurality of circumferentially varying slots 96 is further defined by a first sidewall 124 and a second sidewall 126. Generally similar to the first axial lean angle $\alpha_1$ and the second axial lean angle $\alpha_1$, the first sidewall 124 and the second sidewall 126 of each of the plurality of circumferentially varying slots 96 are inclined at an angle to define a first tangential lean angle $\beta_1$ and a second tangential lean angle $\beta_2$ of the sidewalls 124, 126, relative to a circumferential surface of the compressor endwall of the casing 82. It should be understood that similar tangential lean angles may define the slots 96 when formed into the hub (as previously described). In an embodiment, the tangential lean angle 148 of both the first sidewall 144 and the second sidewall 146 may be equal. In an embodiment, the first tangential lean angle $\beta_1$ and a second tangential lean angle $\beta_2$ may not be equal and designed independently of one another.

As best illustrated in FIG. 10, each of the axial slots 96 includes a geometric shape having an overall linear shape from the first side 124 to the second side wall 126. In an alternate embodiment, each of the axial slots 96 includes a geometric shape having an overall curvilinear shape from the first side 124 to the second side wall 126. Appropriate choice of curvature may minimize aerodynamic loss within the circumferentially varying slots 96, and more particularly minimize energy dissipation near sidewalls meeting at angles present within the slots 96

As best illustrated in FIG. 10, a percentage of the slot area can be defined as total slot non-metal area 128 relative to the blade passage area 115. In an embodiment, the percentage of the total slot non-metal area 128 is between 10% and 90% of the blade passage area 115 and can vary in the radial direction. That is to say, the circumferential coverage of each of the plurality of circumferentially varying slots 196 can vary in the radial direction. By varying the circumferential coverage in the radial direction, it is possible to minimize aerodynamic loss within the plurality of circumferentially varying slots 96.

Figure 13:
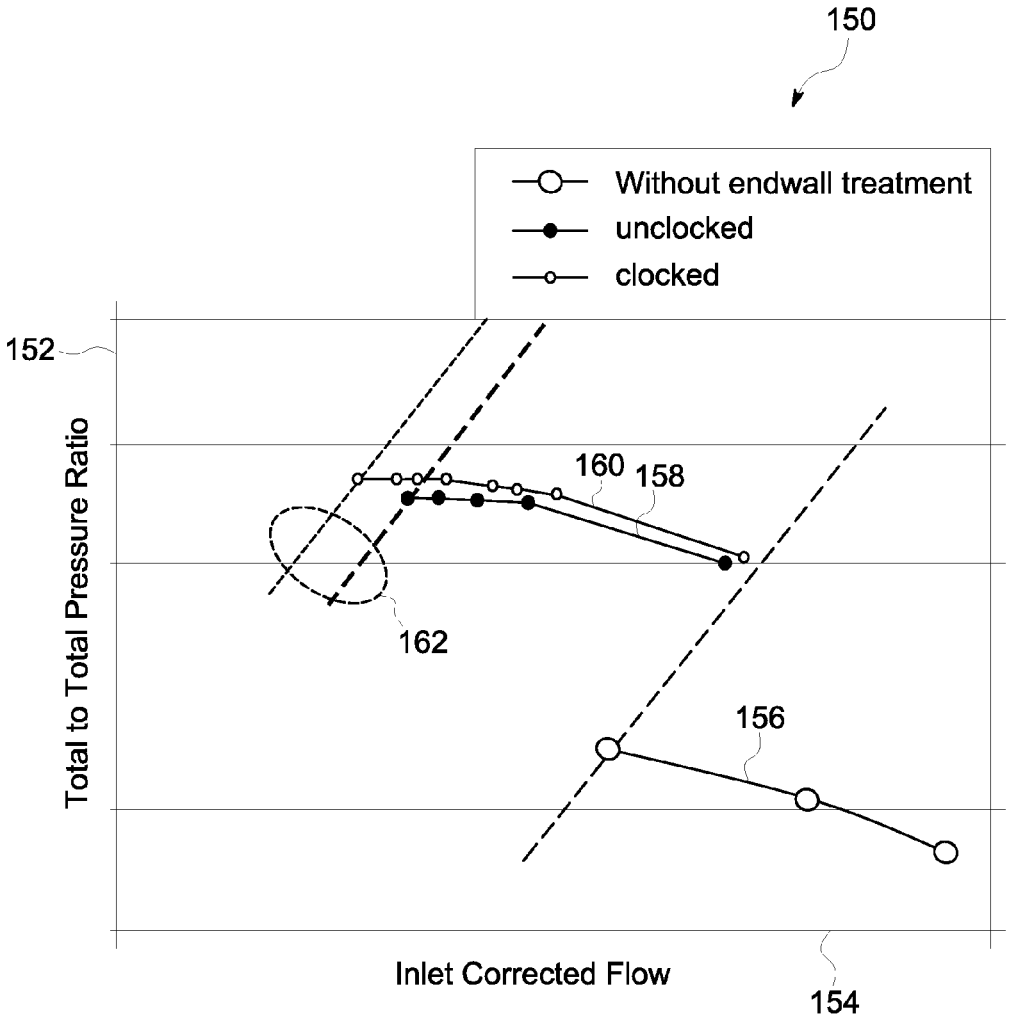
FIG. 13 is a graphical representation illustrating the benefit of a compressor including the one or more endwall treatments as disclosed in accordance with one or more embodiments shown or described herein.

Referring now to FIG. 13, illustrated in an exemplary simulated graphical representation, generally referenced 150, is the benefit of a compressor including the one or more circumferentially varying endwall treatments 94 as disclosed herein, and more particularly when applied to a modern axial compressor rotor, in accordance with an exemplary embodiment. More specifically, graph 150 illustrates the total to total pressure ration (plotted in axis 152) with the inlet corrected flow (plotted in axis 154) of a compressor without circumferentially varying endwall treatments (plotted in line 156), a compressor with circumferentially varying endwall treatments, and more particularly in an unclocked position (plotted in line 158), in accordance with an embodiment described herein, and a compressor with circumferentially varying endwall treatments, and more particularly in a clocked position (plotted in line 160), in accordance with an embodiment described herein. As indicated by line 160 the rotor is able continue to provide a pressure rise at a lower mass flow rate when compared with a compressor that does not include clocking, as plotted at line 158 An extra 0.5-1.0% stall margin (plotted at 162) is achieved between the non-clocked circumferentially varying endwall treatments and the clocked endwall treatments. This extension stable operating range is only representative and can be optimized to be specific to a desired application. Further, these results were obtained using simulation of the unsteady flow with Computational Fluid Dynamics (CFD). Detailed investigation of the flow simulation results also confirms the primary flow mechanism. As previously indicated, the benefit in extending stable operating range and the impact on rotor efficiency depends on how the slot is designed relative to the rotor tip.

Accordingly, as disclosed herein and as illustrated in FIGS. 1 and 4-13, provided are various technological advantages and/or improvements over existing compressor endwall treatments, and in particular endwall treatments that provide for an increase in stall margin, without the negative loss in efficiency in a compressor. The proposed circumferentially varying slots disposed circumferentially about an endwall of a compressor, as disclosed herein, have the potential to provide higher stall margins and operability range of the compressor. The circumferentially varying slot placement relative to an immediately adjacent upstream bladerow, as well as geometric parameters of each of the plurality of circumferentially varying slots may be optimized and adjusted individually for the application on which they are deployed.

The proposed compressor endwall treatments, in addition, may provide an increase in hot day performance for the gas turbine engine, lower dependency on variable stator blades during startup, increase in performance of the rotors at the end of life clearances and lower reliance on transient bleed valves in aviation compressors during icing events.

Exemplary embodiments of an axial compressor endwall treatment and method of controlling leakage flow and circumferential flow non-uniformities therein are described in detail above. Although the endwall treatments have been described with reference to an axial compressor, the endwall treatments as described above can be used in any axial flow system, including other types of engine apparatuses that include a compressor, and particularly those in which an increase in stall margin and reduction in efficiency penalty is desired. Other applications will be apparent to those of skill in the art. Accordingly, the axial compressor endwall treatment and method of controlling leakage flow as disclosed herein is not limited to use with the specified engine apparatus described herein. Moreover, the present disclosure is not limited to the embodiments of the axial compressor described in detail above. Rather, other variations of the axial, mixed and radial compressors including endwall treatment embodiments may be utilized within the spirit and scope of the claims.

This written description uses examples to disclose the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

While there has been shown and described what are at present considered the preferred embodiments of the disclosure, it will be obvious to those skilled in the art that various changes and modifications can be made therein without departing from the scope of the disclosure defined by the appended claims.

What is claimed is:

1. A compressor comprising:

a casing;

a hub;

a cylindrical flow passage formed between the casing and the hub and defining a flow path;

a plurality of blades positioned in the flow path; and a plurality of discrete axial slots formed in a single row, relative to each of the plurality of blades, and along a circumferential direction about an interior surface of at least one of the casing or the hub, the plurality of discrete axial slots configured to return a flow adjacent one of a plurality of rotor blade tips or a plurality of stator blade tips to the cylindrical flow passage and upstream of a point of removal of the flow, wherein each of the plurality of discrete axial slots has a radial height based on their position circumferentially about the interior surface of the at least one of the casing or hub and relative to an immediately adjacent upstream bladerow and wherein the radial height varies between the plurality of discrete axial slots.

2. The compressor as claimed in claim 1, wherein the immediately adjacent upstream bladerow comprises a plurality of stator blades.

3. The compressor as claimed in claim 1, wherein each of the plurality of discrete axial slots is aligned substantially along a principal axis that is perpendicular to a direction of rotation of the plurality of blades.

4. The compressor as claimed in claim 1, wherein the plurality of discrete axial slots include geometric parameters that vary between the plurality of discrete axial slots.

5. The compressor as claimed in claim 4, wherein the geometric parameters comprise one or more of axial lean angles, tangential lean angles, radial height, axial length, bend angles, slot width and planform area.

6. The compressor as claimed in claim 1, wherein the plurality of discrete axial slots include radially varying widths.

7. A method comprising:

introducing a fluid flow along a cylindrical flow passage formed between a casing and a hub of a compressor, the cylindrical flow passage defining a flow path, wherein the compressor further comprises a plurality of blades positioned in the flow path;

extracting a portion of the fluid flow into a plurality of discrete axial slots formed in a single row relative to each of the plurality of blades and along a circumferential direction about an interior surface of at least one of the casing and the hub, the plurality of discrete axial slots configured to return a flow adjacent one of the plurality of rotor blade tips or the plurality of stator blade tips to the cylindrical flow passage upstream of a point of removal of the flow, each of the plurality of discrete axial slots having a radial height based on their position circumferentially about the at least one of the casing or hub and relative to an immediately adjacent upstream bladerow and wherein the radial height varies between the plurality of discrete axial slots; and flowing the portion of the fluid flow through the plurality of discrete axial slots to address circumferential flow non-uniformities introduced by an upstream bladerow.

8. The method of claim 7, wherein the immediately adjacent upstream bladerow comprises a plurality of stator blades.

9. The method of claim 7, wherein each of the plurality of discrete axial slots includes geometric parameters that vary between the plurality of discrete axial slots.

10. The method of claim 9, wherein the geometric parameters comprise one or more of axial lean angles, tangential lean angles, radial height, axial length and planfbrm area.

11. An engine comprising:

a compressor according to claim 1;

a combustor;

a turbine, wherein the compressor, the combustor, and the turbine are configured in a downstream axial flow relationship.

12. The engine of claim 11, wherein the immediately adjacent upstream bladerow comprises a plurality of stator blades.

13. The engine of claim 1, wherein each of the plurality of discrete axial slots includes geometric parameters that vary between the plurality of discrete axial slots.

14. The engine of claim 13, wherein the geometric parameters comprise one or more of axial lean angles, tangential lean angles, radial height, axial length, bend angles, slot width and planform area.

15. The engine of claim 11, wherein the engine is configured for use in an aircraft engine.

* * * * *